US007237577B1

(12) United States Patent
Yacko et al.

(10) Patent No.: US 7,237,577 B1
(45) Date of Patent: Jul. 3, 2007

(54) SYSTEM FOR CONTROLLING CHEMICAL SUBSTANCE APPLICATORS

(75) Inventors: R. Bruce Yacko, Toledo, OH (US); Edward L. Mueller, Toledo, OH (US); John A. Wiegand, Sylvania, OH (US); Jeffrey C. Gayer, Sylvania, OH (US); Todd G. Schimmoeller, Ottawa, OH (US)

(73) Assignee: JAWS International Ltd., Toledo, OH (US)

( * ) Notice: Subject to any disclaimer, the term of this patent is extended or adjusted under 35 U.S.C. 154(b) by 0 days.

(21) Appl. No.: 11/288,525

(22) Filed: Nov. 29, 2005

Related U.S. Application Data

(63) Continuation-in-part of application No. 10/348,646, filed on Jan. 21, 2003, now Pat. No. 6,968,876.

(51) Int. Cl.
*B67D 5/00* (2006.01)

(52) U.S. Cl. ..... 141/94; 141/351

(58) Field of Classification Search ..... 141/351, 141/94

See application file for complete search history.

(56) References Cited

U.S. PATENT DOCUMENTS

| | | | | |
|---|---|---|---|---|
| 3,103,960 | A | 9/1963 | Simjian | |
| 4,929,818 | A | 5/1990 | Bradbury et al. | |
| 5,040,699 | A | 8/1991 | Gangemi | |
| 5,203,387 | A | 4/1993 | Howlett et al. | 141/103 |
| 5,566,732 | A | 10/1996 | Nelson | |
| 5,765,605 | A | 6/1998 | Waymire et al. | 141/100 |
| 6,193,058 | B1 | 2/2001 | Yacko et al. | |
| 6,364,105 | B1 | 4/2002 | Yacko et al. | |
| 6,578,763 | B1 | 6/2003 | Brown | |
| 6,772,944 | B2 | 8/2004 | Brown | |
| 2003/0051767 | A1 | 3/2003 | Coccaro et al. | 141/351 |
| 2004/0020723 | A1 | 2/2004 | Schuman et al. | |

FOREIGN PATENT DOCUMENTS

| | | |
|---|---|---|
| EP | 0725035 | 7/1996 |
| WO | 02/42199 | 5/2002 |
| WO | 03/024814 | 3/2003 |
| WO | 03/086952 | 10/2003 |
| WO | 03/095354 | 11/2003 |

OTHER PUBLICATIONS

International Search Report PCT/US2004/001541.

*Primary Examiner*—J. Casimer Jacyna
(74) *Attorney, Agent, or Firm*—MacMillan, Sobanski & Todd, LLC

(57) ABSTRACT

A system for controlling a plurality of chemical substance applicators in a facility includes establishing a supply of chemical substance applicators, the applicators being configured to contain the chemical substance and to enable the chemical substance to be applied at various locations within the facility, the chemical substance applicators having data indicators identifying data about the chemical substance applicators. One or more reading mechanisms are positioned at one or more locations within the facility, the reading mechanism being capable of reading data from the data indicators on the chemical substance applicators. A plurality of the chemical substance applicators is introduced into the facility, the chemical substance applicators having the data indicators. The movement of chemical substance applicators within the facility is controlled by monitoring data from the chemical substance applicators using the reading mechanism.

14 Claims, 6 Drawing Sheets

SYSTEM FOR CONTROLLING CHEMICAL SUBSTANCE APPLICATORS

RELATED APPLICATIONS

This application is a Continuation-In-Part application of U.S. patent application Ser. No. 10/348,646, filed Jan. 21, 2003 now U.S. Pat. No. 6,968,876, and entitled APPARATUS FOR DISPENSING A SUBSTANCE, all of which is incorporated in the present application in its entirety.

TECHNICAL FIELD

This invention relates to a system for controlling a plurality of chemical substance applicators in a facility.

BACKGROUND OF THE INVENTION

Industrial and commercial firms frequently require the use of industrial solutions, including cleaning solutions, disinfectant solutions and solvents for various purposes. In hospitals, for example, disinfectant solutions are often used on floors and other surfaces to assure a clean environment. A common practice in dispensing cleaning solutions and disinfectant solutions and other chemical substances is to use chemical substance applicators in the form of spray bottles suitable for spraying a liquid chemical substance.

A common problem with the use of receiving containers that are in the form of spray bottles, particularly of spray bottles of cleaning solution, is that some of the spray bottles are not properly returned for refilling and reuse. Instead, some of the spray bottles are either improperly taken and removed from the facility for personal use, or are thrown in the trash in the facility and not recovered or reused. A large factory or other facility such as a hospital can have hundreds of these spray bottles in operation at any one time, and a substantial fraction never make it back for refilling.

It would be advantageous if there could be developed an improved system for controlling a plurality of chemical substance applicators in a facility

SUMMARY OF THE INVENTION

This invention relates to a system for controlling a plurality of chemical substance applicators in a facility. The system includes establishing a supply of chemical substance applicators, the applicators being configured to contain the chemical substance and to enable the chemical substance to be applied at various locations within the facility, the chemical substance applicators having data indicators identifying data about the chemical substance applicators. One or more reading mechanisms are positioned at one or more locations within the facility, the reading mechanism being capable of reading data from the data indicators on the chemical substance applicators. A plurality of the chemical substance applicators is introduced into the facility, the chemical substance applicators having the data indicators. The movement of chemical substance applicators within the facility is controlled by monitoring data from the chemical substance applicators using the reading mechanism.

According to this invention there is also provided a system for controlling a plurality of chemical substance applicators in a facility. The system includes establishing a supply of chemical substance applicators, the applicators being configured to contain the chemical substance and to enable the chemical substance to be applied at various locations within the facility, the chemical substance applicators having data indicators identifying data about the chemical substance applicators. One or more reading mechanisms are positioned at one or more locations within the facility, the reading mechanism being capable of reading data from the data indicators on the chemical substance applicators. A plurality of the chemical substance applicators is introduced into the facility, the chemical substance applicators having the data indicator, and the chemical substance applicators being spray bottles suitable for spraying a liquid chemical substance and containing a liquid chemical substance. The movement of chemical substance applicators within the facility is controlled by monitoring data from the chemical substance applicators at an exit of the facility using the reading mechanism.

According to this invention there is also provided a system for controlling a plurality of chemical substance applicators in a facility. The system includes establishing a supply of chemical substance applicators, the applicators being configured to contain the chemical substance and to enable the chemical substance to be applied at various locations within the facility, the chemical substance applicators having data indicators identifying data about the chemical substance applicators. One or more reading mechanisms are positioned at one or more locations within the facility, the reading mechanism being capable of reading data from the data indicators on the chemical substance applicators. A plurality of the chemical substance applicators is introduced into the facility, the chemical substance applicators having the data indicator, and the chemical substance applicators being spray bottles suitable for spraying a liquid chemical substance and containing a liquid chemical substance. The movement of chemical substance applicators within the facility is controlled by monitoring the presence of the chemical substance applicators using the reading mechanism at a location within the facility where waste material is accumulated.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
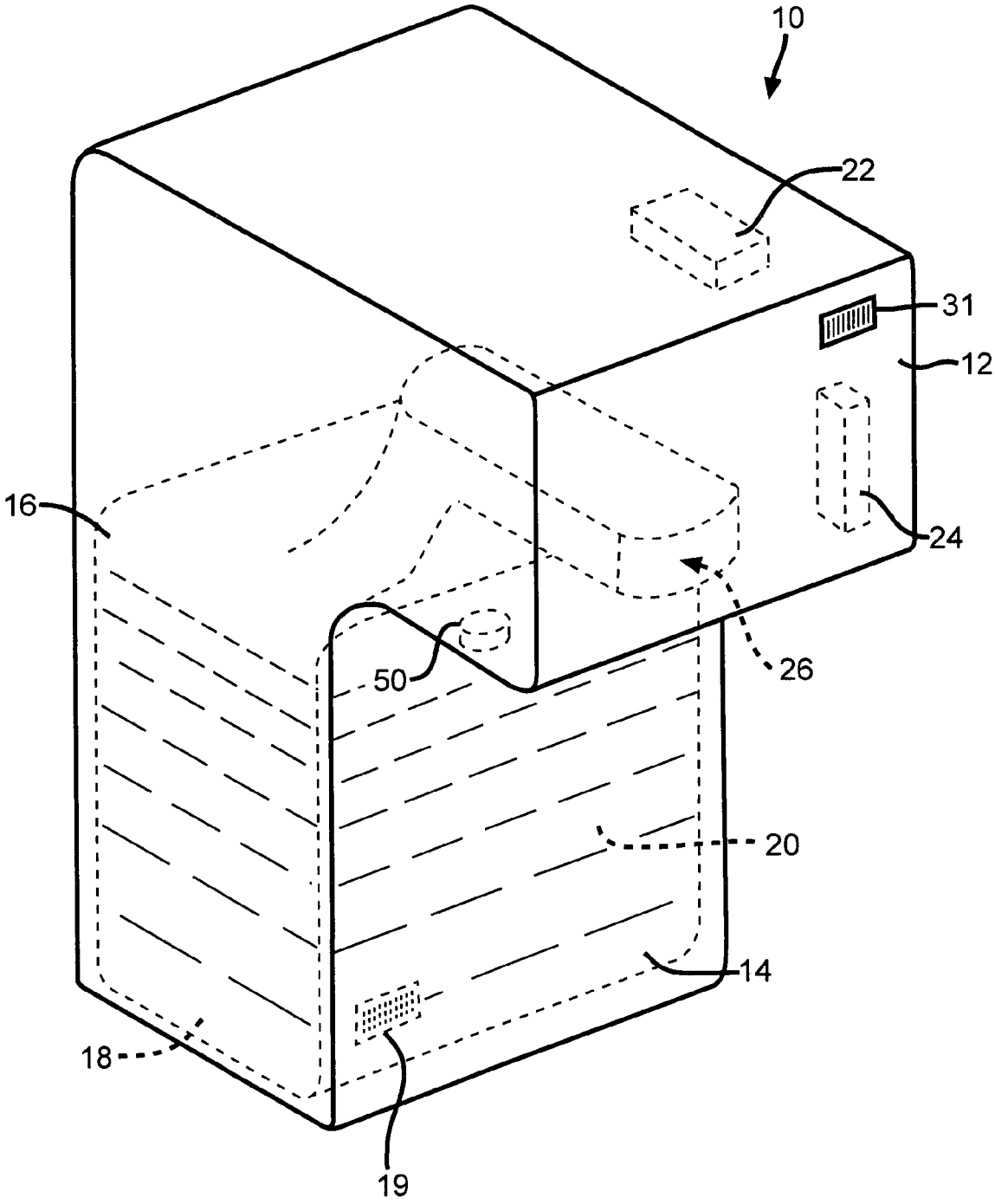
FIG. 1 is a perspective view of a source container dispensing apparatus.

Referring now to the drawings there is illustrated in FIG. 1 a dispensing apparatus 10 for dispensing a substance. The dispensing apparatus 10 as illustrated has an inverted "L"

shape, but the apparatus 10 can have any suitable shape or configuration. As shown, the body of the dispensing apparatus 10 has a generally rectangular upper portion 12 and lower portion 14. The lower portion 14 can act as a base and preferably has a cavity 16 formed therein such that a source container 18 can be positioned inside the apparatus 10. However, it should be understood that the source container 18 could be positioned at any suitable location within or without the apparatus 10. Additionally, the dispensing apparatus 10 could be adapted to have any size or shape. Therefore, the source container 18 could also have any size or shape, wherein the size or shape of the container 18 corresponds to or can be connected to the apparatus 10. Alternatively, the source container 18 could be smaller than the cavity 16 of the apparatus 10 so that multiple source containers 18 could be positioned therein. The source container 18 preferably contains a substance 20 that is to be dispensed from the dispensing apparatus 10. When the contents 20 of the source container 18 have been depleted, the apparatus 10 could be opened, and the source container 18 replaced or refilled. In a preferred embodiment, the source container 18 is a replaceable cartridge. The upper portion 12 of the dispensing apparatus 10 preferably has the capacity to receive a control device or controller 22, a reading mechanism 24 and a dispenser 26. The dispenser 26 of the apparatus, preferably located on the underside of the upper portion 12 of the dispensing apparatus 10, can include a nozzle, valve or tap (not shown). The dispenser 26 can be connected to the source container 18 in any manner such that when the dispenser 26 is activated, the dispenser 26 can discharge a substance 20 from the source container 18. Various appurtenances can also be attached to the body of the dispensing apparatus 10 such as a hose connected to the dispenser 26 or a mechanism to allow the apparatus 10 to be connected to receiving vessel, such as an a mop bucket 28, a maid/maintenance cart, not shown, an auto scrubber, not shown.

The control device or controller 22 of the dispensing apparatus 10 is preferably a microchip, a computer or any other controlling device that acts as a controller for the apparatus 10. The controller 22 operates a program that can be enabled to control how and when the apparatus 10 dispenses the substance 20 from the source container 18. It is preferred that the controller 22 be programmed such that the dispenser 26 can only be activated when the controller 22 allows the dispenser 26 to operate, regardless of whether an operator attempts to operate the dispenser 26. Therefore, it is preferred that the controller 22 be connected to the dispenser 26. It is also preferred that the controller 22 be connected to the reading mechanism 24, which can be an RF (radio-frequency) receiver, a bar code scanner, a magnetic strip reader, a fingerprint reader, a retinal scanner, or any other suitable reading mechanism that is capable of reading data on sources of data. Sources of data can include data indicators 19, 30, 31, which are preferably attached to the dispensing apparatus 10, the source container 18 and a receiving container 32, as shown in FIG. 3.

Figure 2:
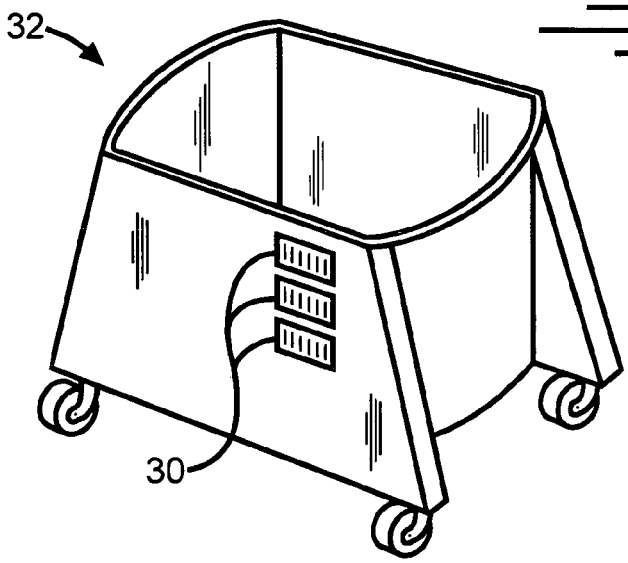
FIG. 2 is an enlarged perspective view of a first receiving container.

As illustrated in FIG. 2, the first example of a receiving container 32 is a conventional mop bucket. The bucket 32 can have any volume, shape or size, but it is preferred that the bucket 32 be appropriately sized such that a mop head or any other type of brush can be positioned inside the bucket 32 to gain access to the materials contained therein. Positioned on the bucket 32, preferably at a convenient location such as on the top of one of the sides or on at least one of the sides, is at least one data indicator 30 for providing information about the bucket 32. As described above, the dispensing apparatus 10 can be adapted to be mounted with the bucket 32 so that the substance 20 to be dispensed can be easily discharged into the receiving container 32.

Figure 3:
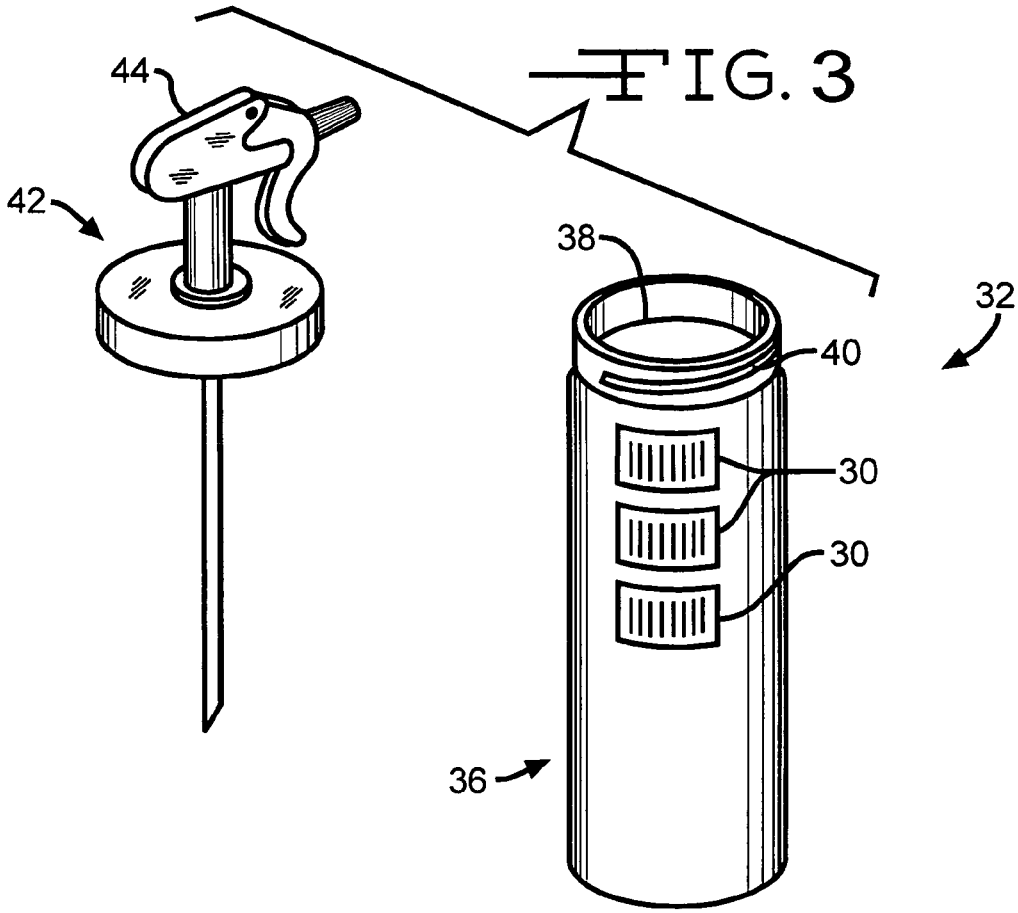
FIG. 3 is an enlarged perspective view of a second receiving container.

Shown in FIG. 3 is a second example of a receiving container in the form of a spray bottle 32 having a cylindrical body 36 with an opening 38 at the top end. The top end also preferably has threads 40 that mate with a corresponding cap 42. The threads 40 could also be used to position the bottle 32 with respect to the dispensing apparatus 10. The cap 42 preferably includes an apparatus that allows for easy discharge of the fluid from the bottle 32, such as a trigger sprayer 44. Positioned on the body 36 of the bottle 32, preferably at a convenient location, is at least one data indicator 30. Although two embodiments of receiving containers have been illustrated, it should be understood that any suitable receiving container could be used with the dispensing apparatus 10.

The reading mechanism or reader 24 is adapted to read the data indicators 30. Depending on the reading mechanism 24, the data indicator 19, 30 could be an RF chip (or transmitter), a bar code, a magnetic strip, or any other data indicator that corresponds to the type of reader 24 that is being used. The data contained on the data indicators 19, 30 preferably includes data about the source container 18 or receiving container 32. The source container data indicator 19 can contain data identifying the substance 20 contained within the source container 18, the amount of the substance 20 that is to be dispensed, the frequency with which the substance 20 can be dispensed, the operating personnel that are permitted to dispense the substance 20, or any other information about the substance 20 or accessibility to the substance. The amount of substance 20 to be dispensed can be based on the actual volume of substance 20 dispensed, on the amount of time the dispenser 26 remains open, or any other suitable measuring parameter. The receiving container data indicator 30 can contain data identifying the substance 20 (or substances) that the container 32 is capable of receiving, the amount of the substance 20 that is to be received, the frequency with which the receiving container 32 can receive the substance 20, who can fill the receiving container 32, or any other desired information about the receiving container 32.

Figure 4:
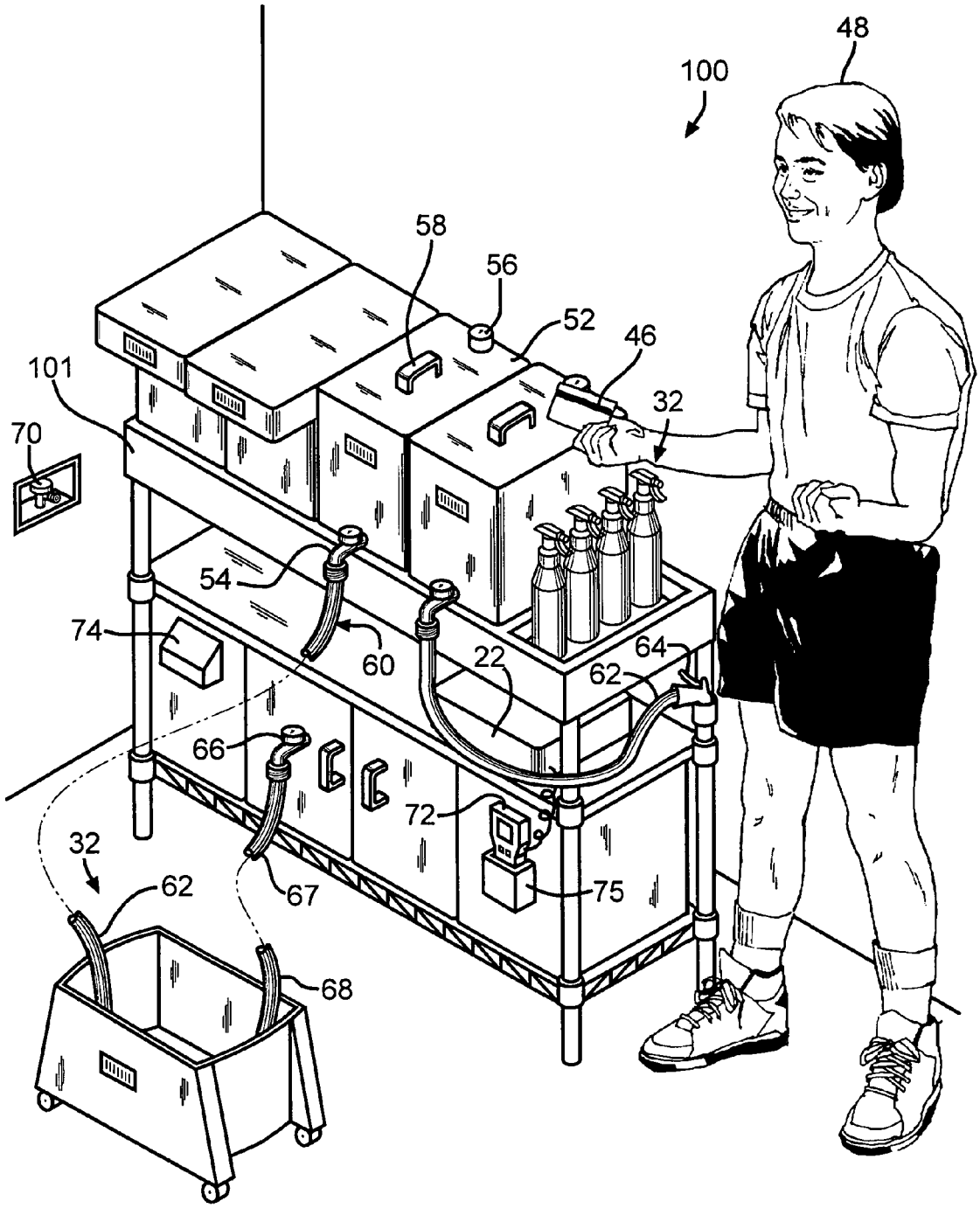
FIG. 4 is a perspective view of an alternate embodiment of a dispensing apparatus.

The controller 22 is preferably programmed such that when certain dispensing conditions are met, the controller 22 will allow the dispenser 26 to discharge an amount of the substance. The dispensing conditions are preferably based on the data that is contained on the data indicators 19, 30. Particularly, the controller 22 could allow the dispenser 26 to activate when the receiving container data indicator 30 is read by the reading mechanism 24 and is a match to a pre-established condition. For example, an RF chip on the receiving container 32 would register with an RF reading mechanism on the apparatus 10 and indicate that the receiving container 32 is the correct container to receive the substance 20 contained in the apparatus 10 (and the source container 18). Alternatively, the receiving container data indicator 30 could be a bar code and the reading mechanism 24 could be a bar code scanner. If the bar code that is read by the scanner matches a code programmed within a database in the program of the controller 22, the controller 22 would allow the dispenser 26 to activate. Additionally, a data indicator 19 could be located on the source container 18 as well. The reading mechanism 24 could then be used to read both the source container data indicator 19 and the receiving container data indicator 30. If the control program detects that both the source data indicator 19 and receiving data indicator 30 correspond to each other the controller 22 would then allow the dispenser 26 to activate. Other dispensing conditions could include a data indicator match between the source 18 and receiving containers 32, and a match between the source or receiving container data indicators 19, 30 and a personnel identification indicator 46, as shown in FIG. 4 where the person 48 is illustrated holding the indicator 46. The personnel identification indicator 46 is a data indicator that contains information about the person 48 attempting to operate the apparatus 10. A plurality of data indicators 19, 30 could be affixed to the source container 18 and receiving container 32 thereby allowing multiple substances 20 to be dispensed, respectively, from or into a container 18, 32. Although it has been described that the source data indicators 19 and the receiving data indicators 30 "match", it should be understood that the term "match" can include any type of correspondence which permits the program of the controller 22 to recognize that a dispensing condition is satisfied thus authorizing activation of the dispenser 26.

It is preferred that the controller be programmed to process the information from the data indicators 19, 30, 46 to determine whether the dispensing conditions are satisfied. Therefore, the control program can receive information from the reading mechanism 24, process the received data and determine whether to activate the dispenser 26 based on the data received. For example, based on data from the data indicators 19, 30, the control program can identify the amount of the substance 20 that is to be dispensed from the source container 18 and the amount of substance 20 to be received in the receiving container 32 and determine whether there is a match between the data indicators 19, 30. Additionally, the controller 22 can be programmed to record the amount of substance 20 discharged per operation of the dispenser 26, the number of receiving containers 32 processed, the frequency with which receiving containers 32 are filled, the operator 48 of the apparatus 10, and the time of day the apparatus 10 is accessed. To prevent theft or waste, the program of the controller 22 can also detect and record whether an operator 48 of the apparatus 10 attempted to dispense a substance 20 at a frequency that exceeds an allowable amount, into an unauthorized container, in a greater amount than permitted, whether an unauthorized operator attempted to use the apparatus 10, who operates the apparatus 10 and when it is operated. It can be appreciated that the controller 22 can be programmed to include a greater or lesser number of parameters, including any other suitable types of information desired to be detected and recorded by the users of the apparatus 10.

In an alternate embodiment, the apparatus 10 has a locating mechanism 50 that can determine whether the receiving container 32 is properly positioned with respect to the dispenser 26 or source container 18. This is to prevent the substance 20 from being dispensed while the receiving container 32 is not appropriately placed. The locating mechanism 50 can be a movable tab that authorizes or enables the dispenser 26 when displaced by the receiving container 32. In a preferred embodiment, the locating mechanism 50 is an optical or infrared scanner. It is further preferred that the locating mechanism 50 also be connected to the controller 22 so that the controller 22 can prevent the dispensing of the substance 20 if the scanner 50 sends a signal to the controller 22 indicating that the receiving container 32 is improperly positioned. Alternatively, the dispensing apparatus 10 can be adapted to lockingly receive the receiving container 32 by using a threaded attachment or snap-in mechanism. Then, the locating mechanism 50 could detect the position of the receiving container 32 and notify the controller 22 that a container 32 is in the proper position for dispensing. The controller 22 could then check the data indicator 30 to ensure that the receiving container 32 is the proper one and that any other dispensing condition is also satisfied prior to activating the dispenser 26 to dispense the substance 20. In an alternate embodiment, the dispensing apparatus 10 could include a combination of the sensors described above and have an actuator such that when the data and position indicators verify that a data and position match has occurred, the operator of the apparatus 10 can depress a button to trigger the apparatus 10 to dispense the substance 20.

Illustrated in FIG. 4 is an alternate embodiment of the system having a dispensing station, indicated generally at 100. The dispensing station 100 includes a dispensing apparatus 10 as described above, and preferably a plurality of dispensing apparatuses. However, each source container 18 could act directly to dispense a substance 20. For example, a source container could be a generally hollow container 52, such as a tank, having an independent outlet 54 or dispenser. Each container 52 could be filled with a liquid, solid or powder material. The dispenser 54 could include any type of release mechanism such as a spigot, valve, faucet, tap, or nozzle. The source container tanks 52 could optionally have an inlet 56 in order to allow for refilling of the container 52. Preferably, the containers 52 are made of a generally clear material so that the quantity of the substance 20 remaining therein is easily discernable by observing the outside of the container 52. Additionally, the source containers 52 are preferably sized to have a multi-gallon capacity. However, the containers 52 can have any size or shape and can be made of any material. The source container tanks 52 can also optionally have handles 58, multiple outlets or inlets, feet or any other appurtenances suitable for use with source containers. Any other suitable source containers, such as jugs, bags or lined boxes may also be used. Attached to each outlet 54 of the source container 52 could be a spigot or a flexible hose 60 such that one end of the hose 60 is connected to the outlet or spigot 54 and the other, dispensing end 62 is adapted to be positioned in or above a receiving container 32. At the dispensing end of the hose 62, there can optionally be a dispenser such as a trigger sprayer 64, tap or nozzle. Alternatively, each source container 18, 52 can dispense directly into a receiving container 32 from the spigot or outlet 54.

The receiving containers 32 can contain water or another diluent prior to receiving the substance. However, pre-filled containers are not required; a diluent can be added to the receiving container 32 after the container receives the substance 20. The receiving container 32 carrying a solution of the substance 20 and diluent can then be used at any location such as a different room, floor, or building as needed. Alternatively, a diluent could be connected to the source container 52 such that upon activation of the dispenser 54, the diluent mixes with the discharge of the source container 52 prior to being dispensed into the receiving container 32. The mixing could be done in a separate chamber or in the hose connecting the source container 52, diluent source 66 and the receiving container 32. Additionally, a plurality of source containers 18, 52 could be connected to a mixing chamber and mix a plurality of substances 20 (including a diluent) prior to discharging a mixture of substances into the receiving container 32.

The source containers 18, 52 are preferably positioned at a dispensing station 100. The dispensing station 100 preferably includes a cart 101 that is optionally mounted on wheels. This would allow the station 100 to be positioned at a central location or moved as needed. In an alternate embodiment, the station 100 can be a permanent, unmovable structure. The source containers 18, 52 can be loosely positioned on or securely fastened to the cart 101 such that they can be refilled, removed, or replaced as needed. The station 100 can also include a hose 67 that is attachable to a diluent source 66 on one end with a nozzle attached to a dispensing end 68. The diluent source can be a permanent source, such as a wall outlet 70, water tap or sink, or a movable source, such as diluent tank 66 supplied on the station 100 or a loose tank (not shown). The dispensing end 68 of the diluent hose 67 is preferably adapted to dispense water or another diluent into the receiving container 32 with ease and efficiency.

Figure 5:
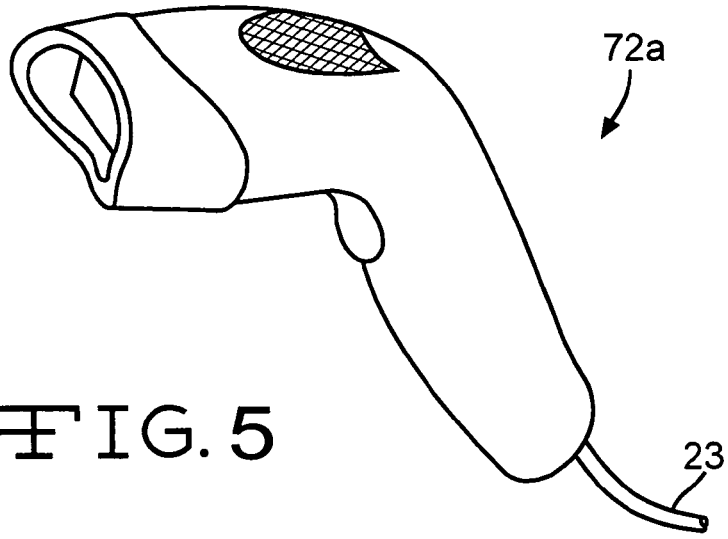
FIG. 5 is an enlarged view of a first handheld reading device.
Figure 6:
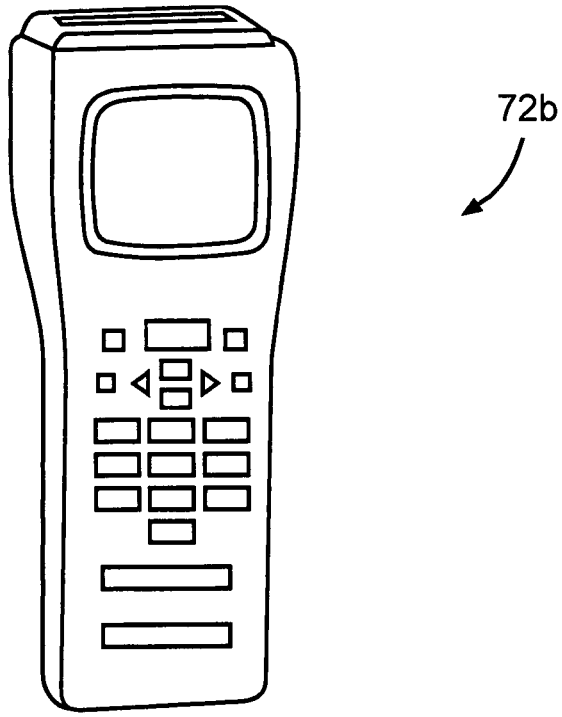
FIG. 6 is an enlarged view of a second handheld reading device.

For safety and cost reasons, it is preferred that only a specified amount of the substance 20 be dispensed into a particular receiving container 32. As described above, the operation of the dispensing apparatus 10, 54 can be managed by programming a controller 22 to process data from the data indicators 19, 30. The data indicators 19, 30 on the receiving container 32 and source container 18, 52 can be a magnetic strip, bar code, colored tag, pre-printed instruction label, or any other identifying indicia. It is preferred that the data indicator 19, 30 be a magnetic strip, bar code or RF system so that a controller 22 operating a data matching and tracking program can determine when and whether a substance 20 is dispensed and thus, removes any potential user confusion. Therefore, it is also preferred that the dispensing station 100 have a reading mechanism 72, 74 such as a magnetic strip reader or scanner device so that the information on the data indicators 19, 30 can be transmitted to the controller 22. The reader 74 can be permanently affixed to the cart as shown in FIG. 4. The receiving container 32 can then be moved to the reader 74 in order to be read. It is preferred that the reader 72 be movable relative to the cart 101. This would allow the reader 72 to be moved toward the item to be read, and thus would be easier to handle by the user. Movable readers 72, such as those shown in FIGS. 5 and 6, are shown as conventional scanning devices. Any suitable scanning/reading device can be used. The handheld reader 72*a* shown in FIG. 5 is preferably adapted to be physically connected to a controller 22 by a cable 23. Many reading devices come with a cable 23 that allows data to be transferred from the reading device 72 to a controller 22. Alternatively, the reading device 72*b* can be wireless, such as the device shown in FIG. 6. If the wireless reading device 72*b* is used, there is preferably a stand or holster 75 of some sort that retains the device 72*b* with the station. Alternatively, a portable reader 72 could be connected to a receiving container 32 such that the reader 72 travels with the receiving container 32.

The controller 22 is preferably attached to the cart 101 of the station 100 and adapted to process the data read by the reader 72, 74 to determine whether a dispensing process should commence. The controller 22 can be programmed similarly to the controller 22 described with respect to the other embodiments. This can prevent a user 48 from siphoning off or pilfering the substance 20, which in many cases can be very expensive. Therefore, in any of the embodiments described herein, the station 100 or dispensing apparatus 10 can be equipped with an alarm (not shown) so that the person 48 using the station 100 or apparatus 10 and others know when an attempt is made to dispense the substance 20 at a frequency faster than a preset rate. An alarm can also be set for attempts to fill an improper receiving container 32, to dispense from a source container 18 to a non-matched receiving container 32, to dispense a greater than authorized amount of the substance 20, to indicate a lack of pre-filling of the receiving container 32 with diluent, and to operate the apparatus 10 or station 100 in violation of the control program. The controller can be programmed to disable the dispenser to prevent dispensing of the substance when the alarm is sounded. The controller 22 should also be adapted to store in a memory device the data read by the reading mechanism 22, 72, 74. The memory device could be made integrally with the controller 22. The information collected by the controller 22 can be downloaded or transmitted to a central computer or master control device for the purpose of inventory control, use information, ordering information, and quality control. The data is preferably stored in the controller 22 using random access memory, read only memory, or on a transferable or portable memory device such as a CD-ROM, flash-ROM chip, floppy disk, or any other suitable computer memory device (not shown). Alternatively, the controller 22 can transmit the data from a stored medium to another computer, master control device or memory storage device via a modem, a plug-in connection to a portable controller, a radio transmitter and receiver system, infrared means (such as via a PALM® operated device or a similar handheld computing device), or any other means. Additionally, the controller 22 could operate as the master control device allowing direct printing or downloading of information from the controller 22.

In a further preferred embodiment, the controller 22 operates a control program that is enabled to determine whether an individual 48 attempting to use the apparatus 10 or station 100 is authorized to do so. This is to prevent theft or misuse of a substance 20 contained in a source container 18 by an untrained individual or a person who should not be accessing the substance. Such a program can be implemented to read a personnel data indicator 46, such as a bar code or magnetic strip, on an individual's nametag, uniform, or personnel identification card 46. Alternatively, more sophisticated systems, such as fingerprint or retinal scanning, can also be used. The reading device for identifying purposes can be the same as the reader 24, 72, 74 for the source container data indicator 19 and receiving container data indicator 30, but a different reader could also be used. It is preferred that the personnel identification reading mechanism be connected to the controller 22 such that the controller 22 can record and track which personnel used the station 100 or apparatus 10, when the station 100 or apparatus 10 was used, and whether an attempt was made to use the station or apparatus improperly. As described above, an alarm (using lights and sound) can be used to indicate to the user 48 and others if someone attempts to access the station 100 or apparatus 10 without authorization or attempts to use it incorrectly.

Although the method and apparatus have been described as dispensing a generic substance 20, it is preferred that the apparatus be used for dispensing chemical concentrates or any other liquid into any type of receiving container. The method and apparatus are particularly adapted for the dispensing of concentrated cleaning chemicals into a diluent-filled dispensing bottle. The method and apparatus can be used to dispense many other substances including ketchup, soda, and fruit juices as well as non-food substances. Also, the dispensing apparatus could dispense a powder such as hot chocolate powder, instant coffee and lemonade powder. Additionally, the dispensing mechanism 26 could be adapted to dispense any type of substance, including solids and powders, such as prescription pills, pesticides or any other material where measured dispensing is advantageous.

Figure 7:
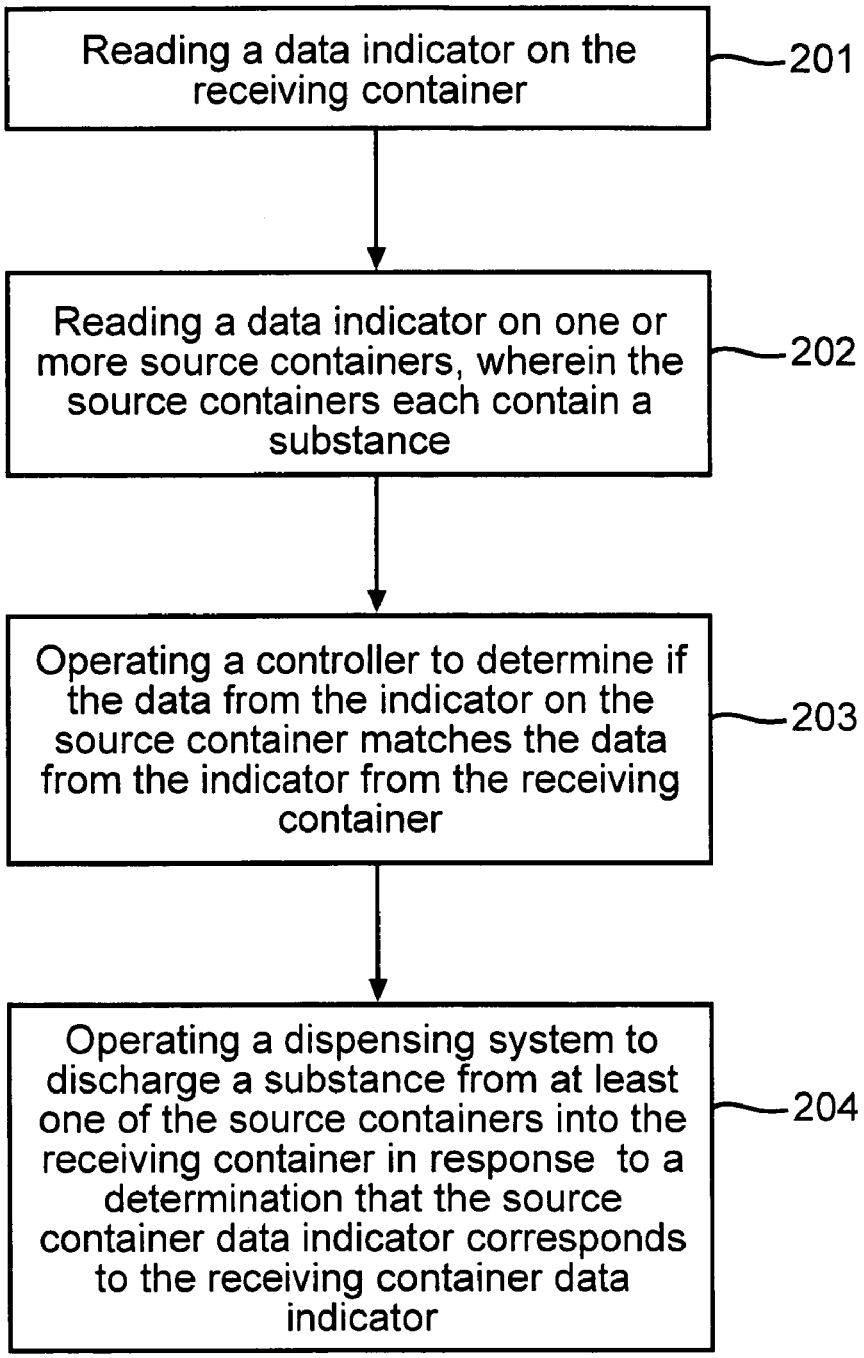
FIG. 7 is a process diagram of the steps of the method of operating the apparatus.

Shown in FIG. 7 is a flow chart depicting the method of operating a dispensing apparatus. The method of dispensing a substance into a receiving container includes: in a first step 201 (a) reading a data indicator on the receiving container; in a second step 202 (b) reading a data indicator on one or more source containers, wherein the source containers each contain a substance; in a third step 203 (c) operating a controller to determine if the data from the indicator on the source container matches the data from the indicator from the receiving container; and in a fourth step 204 (d) operating a dispensing system to discharge a substance from at least one of the source containers into the receiving container in response to a determination that the source container data indicator corresponds to the receiving container data indicator. The controller is programmed to determine when a dispensing condition is satisfied, based on the data from the receiving container, and to generate a signal when the dispensing condition is satisfied. The dispenser is configured to discharge the substance into the receiving container in response to the signal from the controller.

The method can optionally include, individually or jointly, the steps of: (e) operating the controller to dispense an amount of the substance based on data contained on the data indicator; (f) operating the controller to record the amount of the substance discharged, the number of receiving containers filled, the frequency with which receiving containers are filled, and the number of discharges made from the source container; (g) operating the controller to record at least one of the total amount of the substance discharged and the amount of the substance discharged per operation of the dispensing system; (h) operating the controller to limit the frequency with which receiving containers can be filled; (i) operating the controller to communicate the recorded data to a master control device; and (j) operating a mechanism for personnel identification such that the dispensing system is operable only when the system recognizes the personnel as being authorized.

In a particular embodiment, there is provided a system for controlling a plurality of chemical substance applicators, such as the receiving containers 32 disclosed above, in a facility, such as a factory. A common problem with the use of receiving containers, particularly of spray bottles of cleaning solution, is that some of the spray bottles are not properly returned for refilling and reuse. Instead, some of the spray bottles are either improperly taken and removed from the factory for personal use, or are thrown in the trash in the facility and not recovered or reused. A large factory can have hundreds of these spray bottles in operation at any one time, and a substantial fraction never make it back for refilling.

Figure 8:
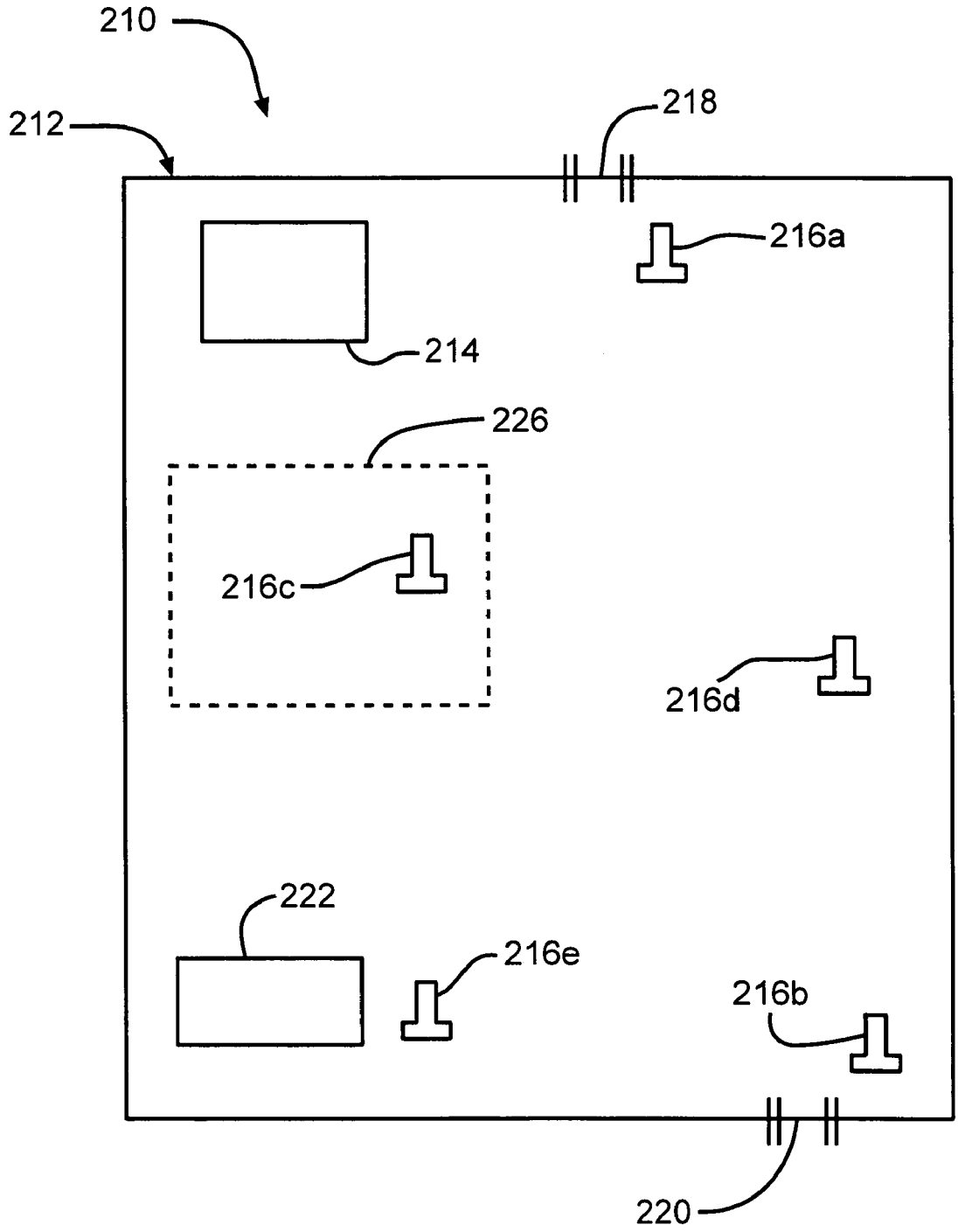
FIG. 8 is a schematic plan view of a facility into which a plurality of chemical substance applicators can be introduced.

As shown in FIG. 8, a system, indicated at 210, is set up to control a plurality of chemical substance applicators, such as spray bottles containing liquid chemical substances. The system 210 is shown as being is operated in a facility 212 that includes one or more stations 214 for filing the chemical substance applicators. The stations 214 can be similar to those disclosed above, or can be of a different configuration. The stations 214 generate or establish a supply of chemical substance applicators that are introduced into the facility 212. The chemical substance applicators can be introduced to the facility 212 in any other suitable manner. The applicators are configured to contain the chemical substance, such as a chemical concentrate and a diluent, and to enable the chemical substance to be applied at various locations within the facility. The chemical substance applicators have data indicators identifying data about the chemical substance applicators. At a minimum, the data indicators identify the chemical substance applicators as one of the plurality of chemical substance applicators that are part of the system 210.

One or more reading mechanisms, indicated generally at 216, are positioned at one or more locations within the facility. The reading mechanisms 216 are capable of reading data from the data indicators on the chemical substance applicators. The reading mechanisms 216 can be RF receivers or any other suitable reading mechanisms. Likewise, the data indicators on the chemical substance applicators can be an RF chip or any other suitable indicator as long as it is compatible with the reading mechanism.

The reading mechanisms 216 are strategically placed in the facility 212. For example, the reading mechanisms 216*a* and 216*b* are placed near building exits 218 and 220, respectively. Other reading mechanisms 216*c*, 216*d*, and 216*e* are placed strategically around the facility. It can be seen that when someone attempts to remove one of the chemical substance applicators from the facility 212 via either exit 218 or exit 220, the reading mechanisms 216*a* and 21*b*, respectively, will recognize or detect the chemical substance applicators and will activate an alarm or other signal indicating the presence of one or more of the chemical substance applicators. In this manner, the movement of chemical substance applicators within the facility 212 is controlled by monitoring data from the chemical substance applicators using the reading mechanisms 216. The system can be configured so that the detection of a chemical substance applicator by a reading mechanism 216*a*, 216*b* at the exit 218, 220 of the facility is recorded on a recording mechanism connected to the reading mechanism.

Another prime location within the factory 212 for placement of a reading mechanism is at a location within the facility where waste material is accumulated. As shown in FIG. 8, there is a location where all or a substantial portion of the waste from the facility 212 is directed and accumulated. Typically, there will be a waste facility, such as a trash compactor 222 or similar device, at such a location. A reading mechanism 216*e* is strategically positioned at the trash compactor 222 to detect any of the chemical substance applicators that are included in the trash being directed to the waste facility. When the reading mechanism 216*e* detects one of the chemical substance applicators, an alarm or other signal can be set off, providing a notice for an operator to retrieve the chemical substance applicator from trash. In this way, the system is controlling the movement of chemical substance applicators within the facility.

According to the system described above, the reading mechanisms 216 can detect the presence of the chemical substance applicators. The reading mechanisms can also be configured to distinguish between different kinds of chemical substance applicators, and this can be used to control the movement of the chemical substance applicators within the facility. If there is a particular substance in some of the chemical substance applicators that must be prevented from entering a specific portion of the factory 212, then the system can beneficially control the movement of the chemical substance applicators. For example, if certain substances contained in some of the chemical substance applicators are required to be kept out of a zone 226 of the factory 212, then the reading mechanism 216*c* can be used to prevent the introduction of such chemical substance applicators into the zone 226.

The principle and mode of operation of this invention have been described in its preferred embodiments. However, it should be noted that this invention may be practiced otherwise than as specifically illustrated and described without departing from its scope.

What is claimed is:

1. A system for controlling a plurality of chemical substance applicators in a facility, the facility having one or more exits, the system comprising:

establishing a supply of chemical substance applicators, the applicators being configured to contain the chemical substance and to enable the chemical substance to be applied at various locations within the facility, the chemical substance applicators having data indicators identifying data about the chemical substance applicators;

positioning one or more reading mechanisms at the one or more exits, the reading mechanisms being capable of reading data from the data indicators on the chemical substance applicators;

introducing a plurality of the chemical substance applicators into the facility, the chemical substance applicators having the data indicators; and controlling the movement of chemical substance applicators within the facility by monitoring data from the chemical substance applicators using the one or more reading mechanisms at the one or more exits and preventing the chemical substance applicators from exiting the facility.

2. The system of claim 1 in which the chemical substance applicators are spray bottles suitable for spraying a liquid chemical substance.

3. The system of claim 2 in which the spray bottles contain a liquid chemical substance.

4. The system of claim 1 in which the one or more reading mechanisms are connected to an alarm, and in which detection of a chemical substance applicator by a reading mechanism at the one or more exits of the facility activates the alarm.

5. The system of claim 1 in which the one or more reading mechanisms are connected to a recording mechanism, and in which detection of a chemical substance applicator by a reading mechanism at the one or more exits of the facility is recorded on the recording mechanism.

6. The system of claim 1 in which the one or more reading mechanisms for reading the data is an RF receiver, and the data indicators on the chemical substance applicators are RF chips.

7. A system for controlling a plurality of chemical substance applicators in a facility, the facility having a location where waste material is accumulated, the system comprising:

establishing a supply of chemical substance applicators, the applicators being configured to contain the chemical substance and to enable the chemical substance to be applied at various locations within the facility, the chemical substance applicators having data indicators identifying data about the chemical substance applicators;

positioning one or more reading mechanisms at one or more locations within the facility, the reading mechanisms being capable of reading data from the data indicators on the chemical substance applicators;

introducing a plurality of the chemical substance applicators into the facility, the chemical substance applicators having the data indicator, and the chemical substance applicators being spray bottles suitable for spraying a liquid chemical substance and containing a liquid chemical substance; and controlling the movement of chemical substance applicators within the facility by monitoring the presence of the chemical substance applicators using the reading mechanism at the location within the facility where waste material is accumulated.

8. The system of claim 7 in which the one or more reading mechanisms are connected to an alarm, and in which detection of a chemical substance applicator by a reading mechanism at the waste material accumulation location activates the alarm.

9. The system of claim 8 in which the one or more reading mechanisms are connected to a recording mechanism, and in which detection of a chemical substance applicator by a reading mechanism at the waste material accumulation location is recorded on the recording mechanism.

10. The system of claim 7 in which the one or more reading mechanisms for reading the data are RF receivers and the data indicators on the chemical substance applicators are RF chips.

11. A system for controlling a plurality of chemical substance applicators in a facility comprising:

establishing a supply of chemical substance applicators, the applicators being configured to contain the chemical substance and to enable the chemical substance to be applied at various locations within the facility, the chemical substance applicators having data indicators identifying data about the chemical substance applicators;

positioning one or more reading mechanisms at one or more locations within the facility, the reading mechanisms being capable of reading data from the data indicators on the chemical substance applicators;

introducing a plurality of the chemical substance applicators into the facility, the chemical substance applicators having the data indicators, and the chemical substance applicators being spray bottles suitable for spraying a liquid chemical substance and containing a liquid chemical substance; and controlling the movement of chemical substance applicators within the facility by monitoring data from the chemical substance applicators using the reading mechanism and preventing the chemical substance applicators from entering a specific portion of the facility.

12. The system of claim 11 in which the one or more reading mechanisms are connected to an alarm, and in which detection of a chemical substance applicator by a reading mechanism at an exit of the facility activates the alarm.

13. The system of claim 11 in which the one or more reading mechanisms are connected to a recording mechanism, and in which detection of a chemical substance applicator by a reading mechanism at an exit of the facility is recorded on the recording mechanism.

14. The system of claim 11 in which the one or more reading mechanisms for reading the data are RF receivers and the data indicators on the chemical substance applicators are RF chips.

* * * * *